US008439601B2

(12) United States Patent
Lara

(10) Patent No.: US 8,439,601 B2
(45) Date of Patent: May 14, 2013

(54) CONTAINMENT BOOM MOORING SYSTEM

(76) Inventor: Kim A. Lara, Kodiak, AK (US)

( * ) Notice: Subject to any disclaimer, the term of this patent is extended or adjusted under 35 U.S.C. 154(b) by 366 days.

(21) Appl. No.: 12/792,893

(22) Filed: Jun. 3, 2010

(65) Prior Publication Data

US 2011/0297066 A1 Dec. 8, 2011

(51) Int. Cl.
*E02B 15/04* (2006.01)

(52) U.S. Cl.
USPC ..... 405/63; 405/60; 405/64; 405/65; 405/70; 405/71; 248/316.1

(58) Field of Classification Search ..... 405/63, 405/60, 64, 65, 70, 71, 72; 114/23; 248/316.1
See application file for complete search history.

(56) References Cited

U.S. PATENT DOCUMENTS 3,807,178 A * 4/1974 Tanksley ..... 405/67
3,868,824 A 3/1975 Thurman
4,320,991 A 3/1982 Rogers
5,887,710 A * 3/1999 London et al. ..... 206/289
6,439,526 B1 * 8/2002 London ..... 248/316.5
6,793,186 B2 * 9/2004 Pedersen ..... 248/229.13
8,136,709 B2 * 3/2012 Jeli et al. ..... 224/323
2006/0034668 A1 2/2006 Knezek et al.
2008/0267717 A1 10/2008 Meyers

* cited by examiner

*Primary Examiner* — Frederick L Lagman
*Assistant Examiner* — Carib Oquendo
(74) *Attorney, Agent, or Firm* — Neustel Law Offices

(57) ABSTRACT

A containment boom mooring system for efficiently anchoring containment booms over extended periods of time and in varying sea conditions. The containment boom mooring system generally includes a clamping frame having a first and second frame section pivotally connected upon a first end and having a latching assembly upon a second end for securing the frame sections in a pivotally closed position, a first and second resilient retainer extending along the inner sides of the first and second frame sections to frictionally engage a first side and a second side of a containment boom, a first and a second buoyancy member extending from the first and second frame sections, and an anchor assembly extending from the clamping frame which is adapted to extend below a water surface for mooring the clamping frame.

19 Claims, 6 Drawing Sheets

CONTAINMENT BOOM MOORING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a containment boom and more specifically it relates to a containment boom mooring system for efficiently anchoring containment booms over extended periods of time and in varying sea conditions.

2. Description of the Related Art

Any discussion of the related art throughout the specification should in no way be considered as an admission that such related art is widely known or forms part of common general knowledge in the field.

Containment booms have been in use for years and are typically utilized to contain leaked or spilled contaminants or substances, such as oil, within water bodies. The containment booms are generally comprised of elongated sections adapted to float in the water in a semi-rigid manner and generally have an anchoring system extending from the underside of the sections along the length of the sections.

One problem with existing anchoring systems is that because the anchoring system is affixed to the underside of the containment boom, the weight of the anchoring system must be minimal to avoid ripping or tearing the containment boom, as well as to allow movement of the containment boom through the water body. Because of the lightweight anchoring system, the containment booms often times cannot be efficiently anchored during rough sea conditions. Because of the inherent problems with the related art, there is a need for a new and improved boom mooring system for efficiently anchoring containment booms over extended periods of time and in varying sea conditions.

BRIEF SUMMARY OF THE INVENTION

A system for efficiently anchoring containment booms over extended periods of time and in varying sea conditions. The invention generally relates to a containment boom which includes a clamping frame having a first and second frame section pivotally connected upon a first end and having a latching assembly upon a second end for securing the frame sections in a pivotally closed position, a first and second resilient retainer extending along the inner sides of the first and second frame sections to frictionally engage a first side and a second side of a containment boom, a first and a second buoyancy member extending from the first and second frame sections, and an anchor assembly extending from the clamping frame which is adapted to extend below a water surface for mooring the clamping frame.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview.

Figure 1:
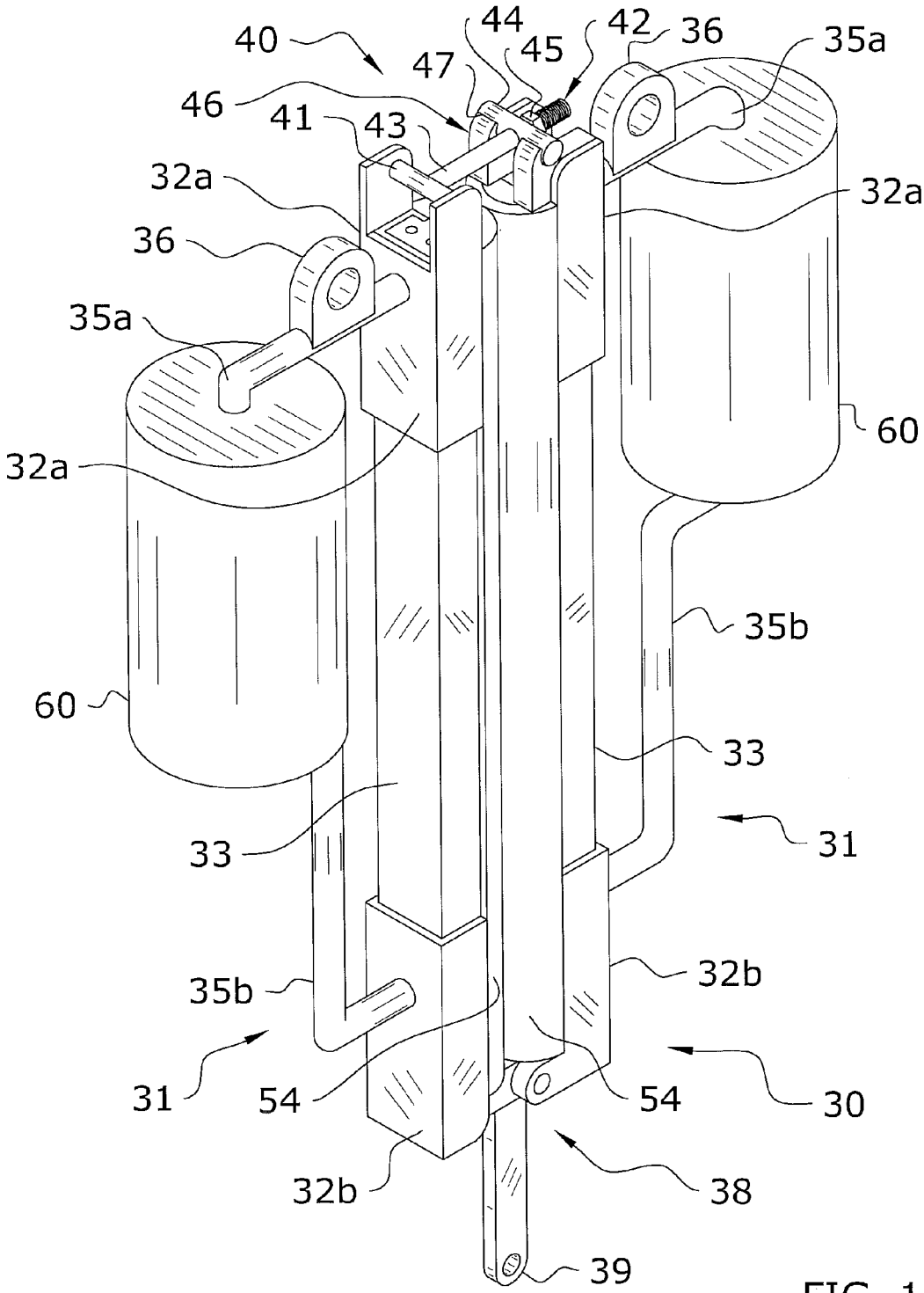
FIG. 1 is an upper perspective view of the clamping assembly in a closed position.
Figure 2:
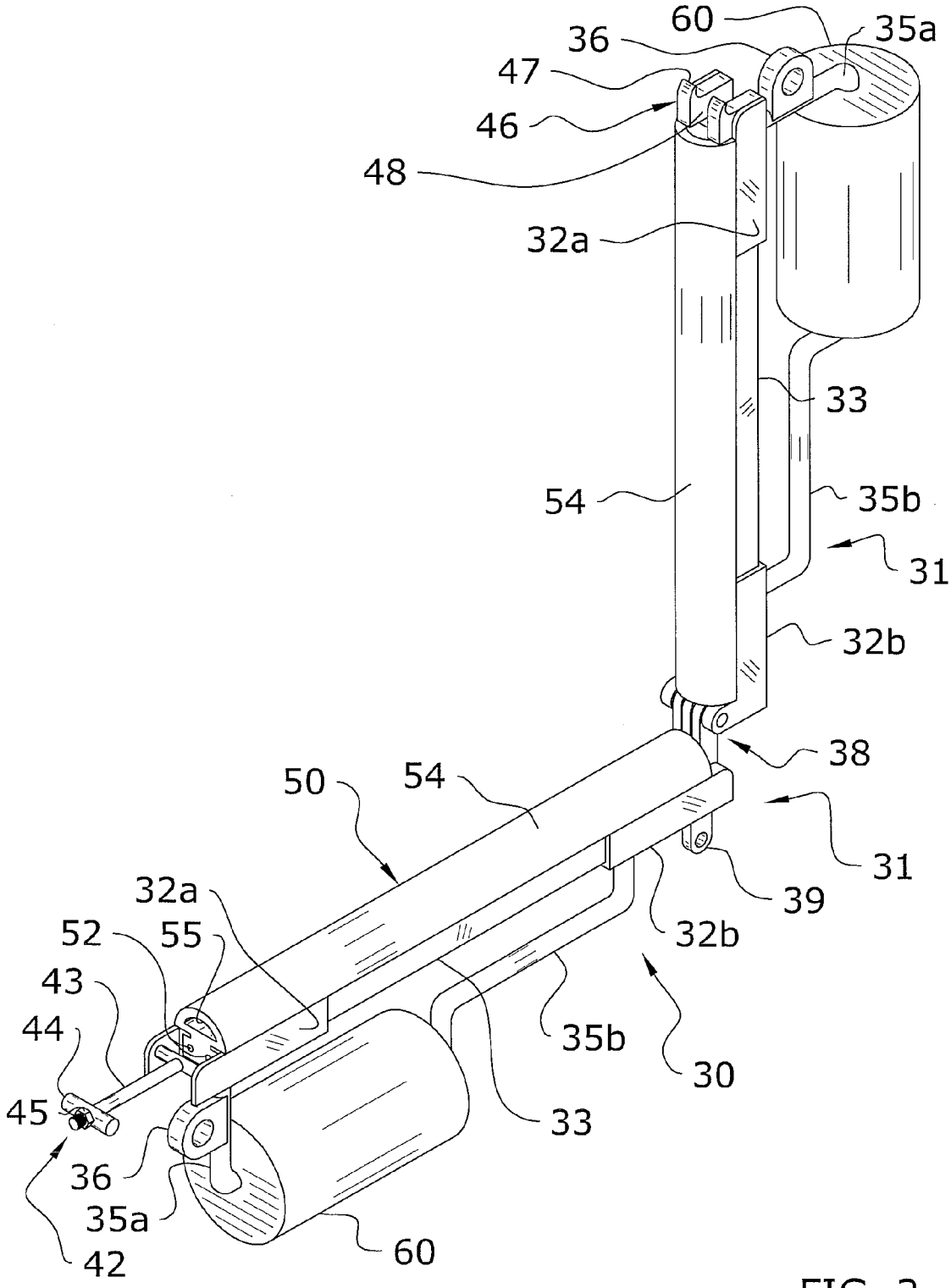
FIG. 2 is an upper perspective view of the clamping assembly in an open position.
Figure 3:
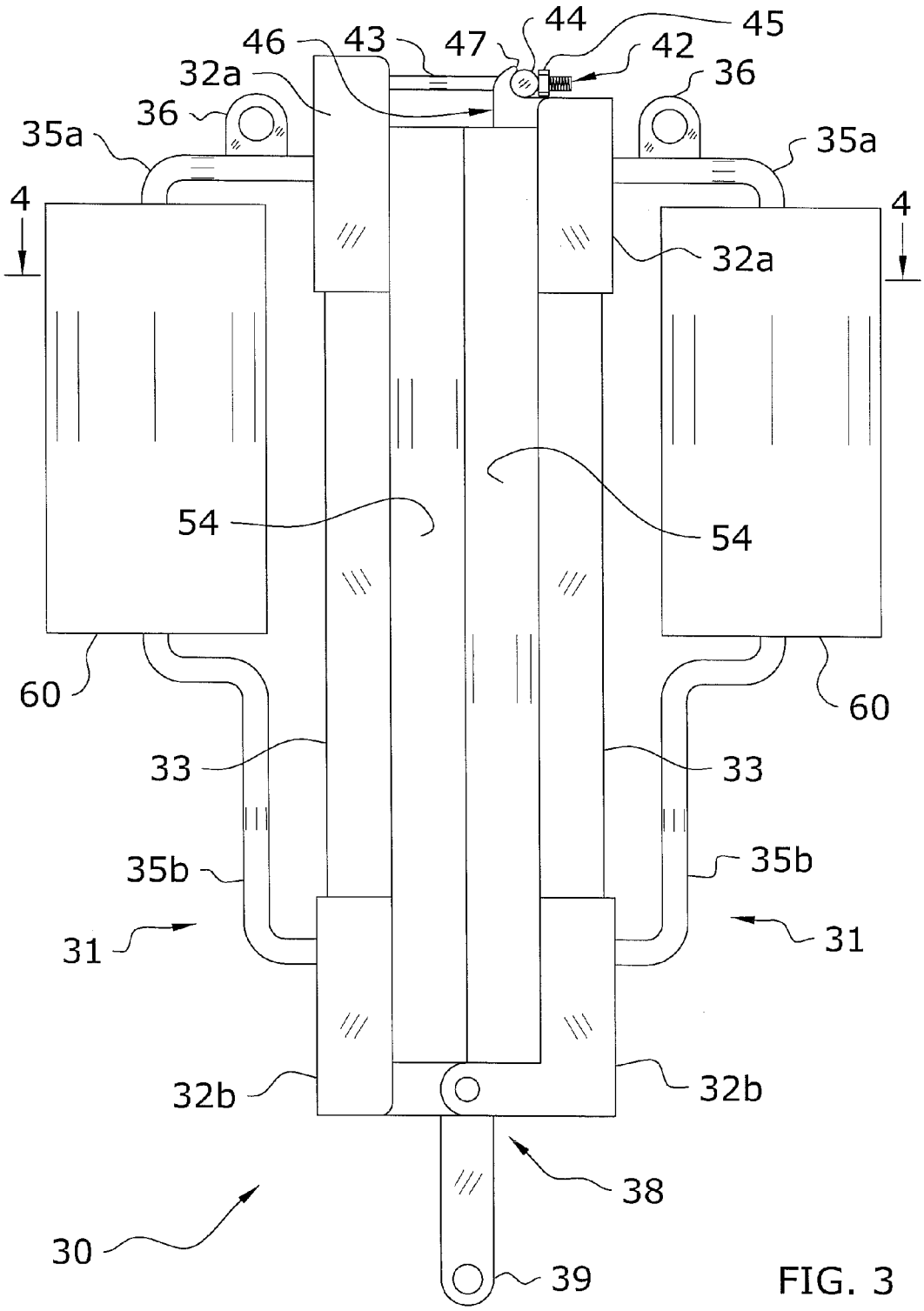
FIG. 3 is a side view of the clamping assembly in a closed position.
Figure 4:
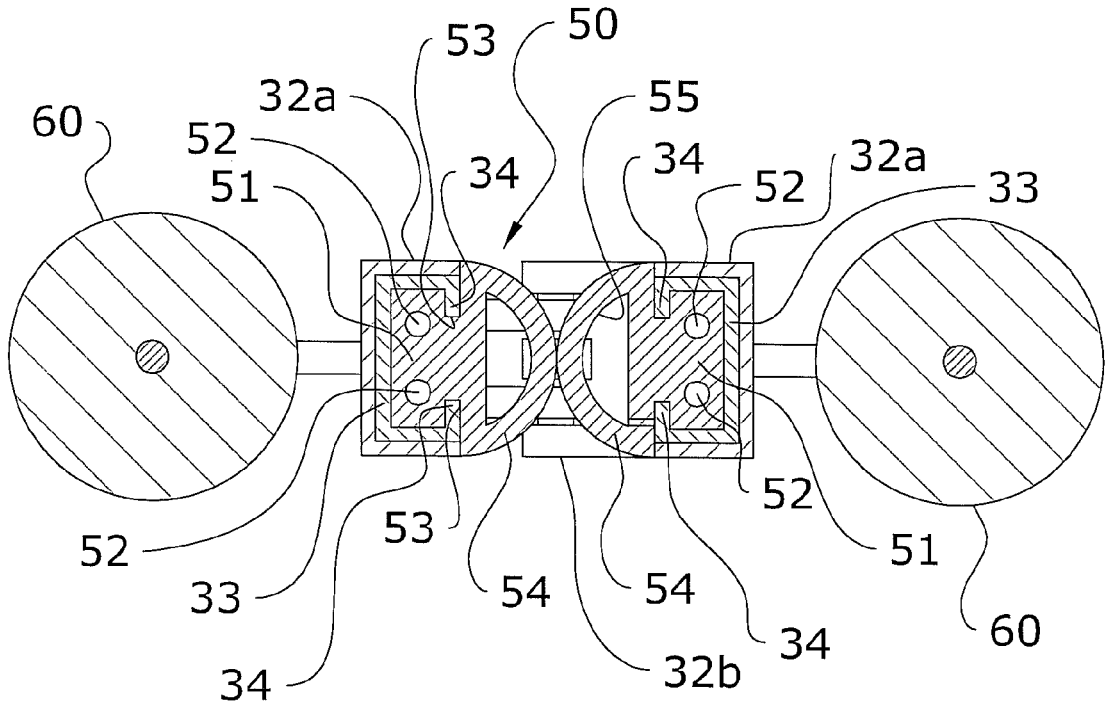
FIG. 4 is a sectional view taken along lines 4-4 of FIG. 3.
Figure 5:
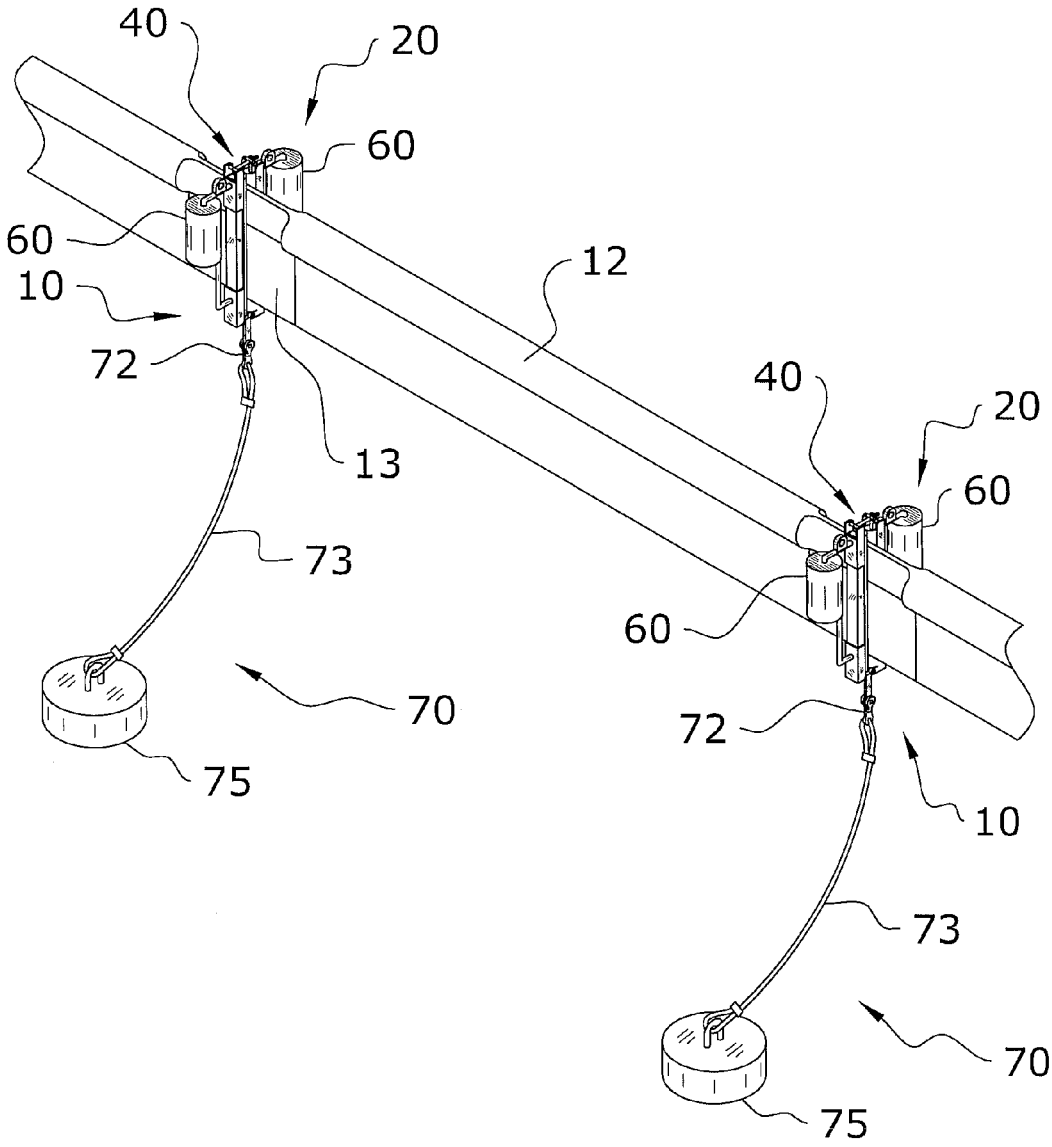
FIG. 5 is an upper perspective view of the present invention attached to a containment boom.
Figure 6:
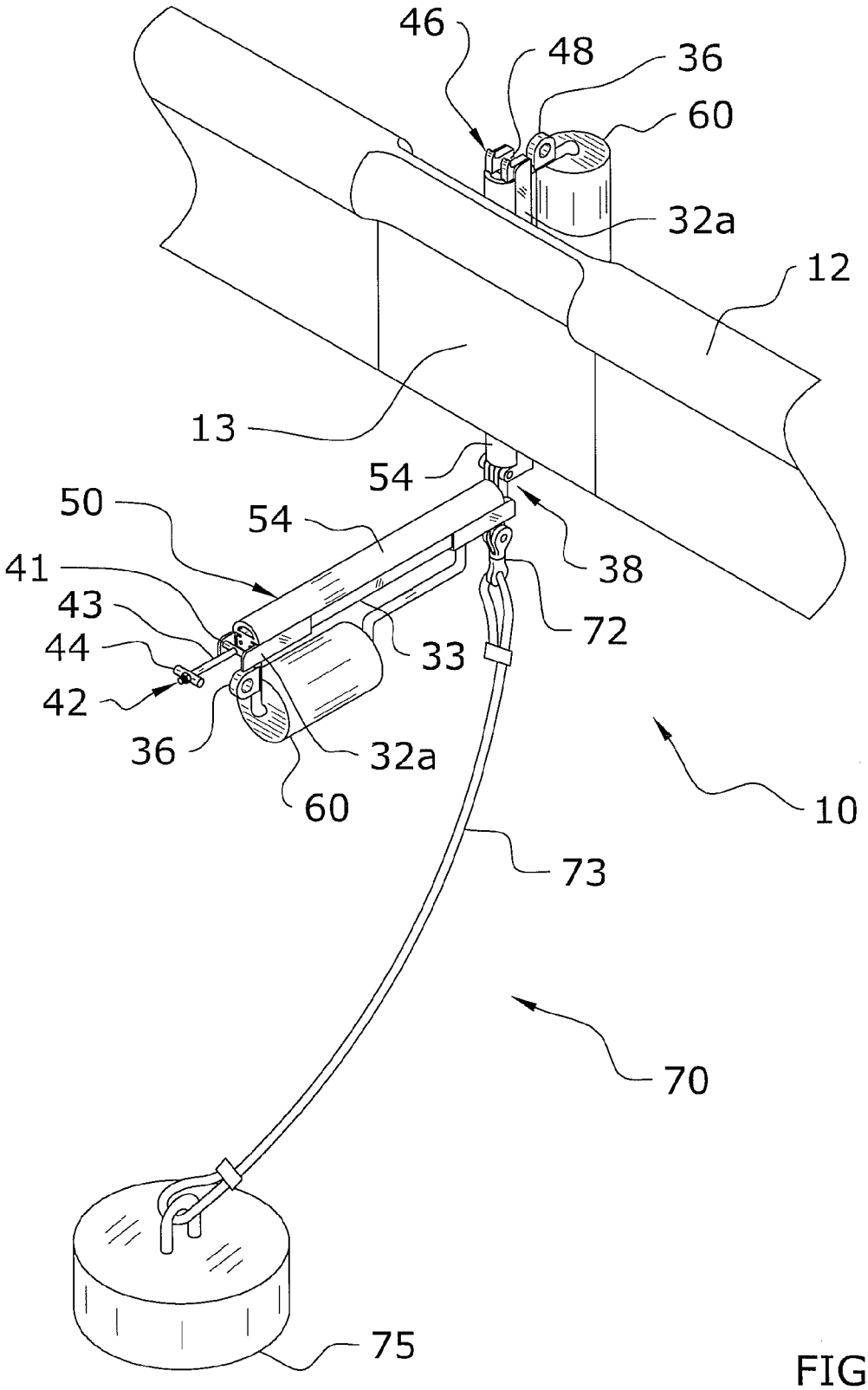
FIG. 6 is an upper perspective view of the present invention being attached to a containment boom, wherein the clamping assembly is in the open position.

Turning now descriptively to the drawings, in which similar reference characters denote similar elements throughout the several views, FIGS. 1 through 6 illustrate a containment boom mooring system 10, which comprises a clamping frame 30 having a first and second frame section 31 pivotally connected upon a first end and having a latching assembly 40 upon a second end for securing the frame sections 31 in a pivotally closed position, a first and second resilient retainer 50 extending along the inner sides of the first and second frame sections 31 to frictionally engage a first side and a second side of a containment boom 12, a first and a second buoyancy member 60 extending from the first and second frame sections 31, and an anchor assembly 70 extending from the clamping frame 30 which is adapted to extend below a water surface for mooring the clamping frame 30.

The present invention may be used within various types of bodies of water, such as seas, lakes, oceans, rivers, ponds, etc. The containment booms 12 are generally comprised of conventional containment booms and thus are not described in detail herein.

B. Clamping Assembly.

The clamping assembly 20 is structured to clamp against first and second sides of the containment boom 12 and be oriented vertically with respect to the horizontally extending containment boom 12. The clamping assembly 20 is generally clamped along a folding portion, connecting portion, or other substantially flat portion 13 of the containment boom 12 so that the clamping assembly 20 can adequately clamp together and maintain a substantially vertical orientation.

The clamping assembly 20 includes a frame 30 having a first and second frame section 31. Each of the frame sections 31 are preferably identical in structure. The first and second frame sections 31 are generally separably formed to pivot and clamp together over the first and second sides of the containment boom 12; however integral structures may be appreciated. The frame sections 31 may be comprised of various materials, such as but not limited to metal, aluminum, plastic, etc. Extending from a lower end of the frame 30 or hinge assembly 38 of the frame 30 is preferably a lower connector 39. The lower connector 39 may have an opening or other connecting means to attach the clamping assembly 20 to the anchor assembly 70.

Each of the frame sections 31 generally includes upper and lower U-shaped channel members 32*a*, 32*b*, with a lower channel member 32*b* extending along a lower vertical length of the frame sections 31 and an upper channel member 32*a* extending along an upper vertical length of the frame sections 31. Preferably extending from an upper end of the upper channel members 32*a* is a latch assembly 40 for retaining the frame sections 31 and clamp assembly 20 in a closed position. Preferably extending from a lower end of the lower channel members 32*b* is a hinge assembly 38 to pivotally connect the frame sections 31 upon the lower end. The hinge assembly 38 generally comprises interlocking fingers and a joining pin; however other structures may be appreciated.

Generally, a gap is formed between the upper and lower outer channel members 32*a*, 32*b* thus reducing the weight of the frame 30 to provide a more buoyant structure and provide less stress upon the containment boom 12. However, it is appreciated that the channel members 32*a*, 32*b* may be continuous along a vertical length of the frame 30 in alternate embodiments. An inner channel member 33 preferably extends from a top to a bottom of each frame section 31 and is received by the outer channel members 32*a*, 32*b* and extends along the gap formed by the outer channel members 32*a*, 32*b*. The inner channel members 33 each include a lip 34 for retaining the retainer 50 therein. The inner channel member 33 may be attached to the outer channel members 32*a*, 32*b* in various manners or may be integrally formed with the outer channel members 32*a*, 32*b* in alternate embodiments of the present invention.

The frame sections 31 also each preferably include upper and lower retaining brackets 35*a*, 35*b* extending along an outer side and from the upper and lower channel members 32*a*, 32*b*. The retaining brackets 35*a*, 35*b* are for supporting the buoyancy members 60 in a vertical orientation on an exterior side of the frame sections 31. Along the upper retaining brackets 35*a* is preferably a lifting loop 36 for providing an attachment point for handling the clamping assembly 20 over the side of the boat, such as to maneuver the clamping assembly 20 and anchoring assembly 70 before or after attachment to the containment boom 12. Alternate loop or hook structures may be appreciated for the lifting loops 36.

The latch assembly 40 is generally located at an upper end of the frame 30 to provide easy access when the frame 30 is attached around the containment boom 12. The latch assembly 40 generally comprises a pivotal connector 41 and latch 42 on one side of the frame 30 and a pair of receivers 46 upon an opposing side of the frame 30 for retaining the frame 30 and clamping assembly 20 in a closed position. The latch 42 generally comprises a T-shaped latch 42 having an elongated arm 43 and a perpendicular catch member 44 extending from a distal end of the arm 43. The receivers 46 are separated by a slot 48 for receiving the arm 43 of the latch 42 and the receivers 46 also generally include a curved hook portion 47 extending from an upper side of the receivers 46 for receiving the cylindrical catch member 44 to retain the frame sections 31 together and in a closed position. The end of the arm 43 may be threaded for receiving a nut 45 to tighten the catch member 44 against the hook portion 47 of the receivers 46 to ensure that the latch 42 does not unintentionally disconnect.

The clamp assembly 20 includes a pair of retainers 50 to line the inner sides of the frame sections 31 for frictionally engaging the opposing sides of the containment boom 12 in a manner to prevent the clamp assembly 20 from vertically or horizontally sliding along the containment boom 12 when the clamp assembly 20 is in a closed position. The retainers 50 preferably extend along an entire length of the frame sections 31 from a lower end to an upper end. Each of the retainers 50 are preferably identical in structure and preferably are resilient in structure, such as being comprised of a rubber bulb structure. The rubber and resilient structure of the retainers 50 also is useful in protecting the fabric of the containment boom 12.

Each of the retainers 50 preferably includes a receiver portion 51 having a rectangular cross-section 34 to fit within the inner channel members 33 of the frame sections 31. The lips 34 of the channel members wrap around the front of the elongated receiver portions 51 to fit within the elongated longitudinal notch 53 formed between the receiver portion 51 and the contact portion 54. Extending from the receiver portions 51 toward a longitudinal center of the frame 30 is a contact portion 54. The contact portion 54 preferably has a dome-shaped face for directly contacting the respective side of the containment boom 12.

Each of the retainers 50 also generally includes longitudinal openings 52 extending through the length of the receiver portion 51 of the retainer 50. The openings 52 allow the receiver portion 51 to compress and also provide a point of attachment to the retainer 50. The contact portion 54 preferably includes a dome-shaped channel 55 extending throughout a longitudinal length of the retainer 50 which allows the contact portion 54 to compress when the clamping assembly 20 is being clamped around the containment boom 12.

The buoyancy members 60 may be comprised of various types of floatation structures all which maintain the clamping assembly 20 in a vertical orientation when clamped around and connected to the containment boom 12. The buoyancy members 60 are retained in a vertical orientation by the upper and lower retaining brackets 35*a*, 35*b*. It is appreciated that various buoyant materials may be utilized with the buoyancy members 60 all which are able to remain buoyant over extended periods of time, such as by not becoming waterlogged, and are able to support large amounts of weight.

C. Anchoring Assembly.

Various types of anchor assemblies 70 may be utilized with the clamping assembly 20 to prevent the containment booms 12 from moving the clamping assembly 20 when connected thereto. The anchor assemblies 70 may be utilized in deep or shallow waters and during rough or calm sea conditions.

The anchoring assembly 70 generally includes an elongated member 73 extending from the clamping assembly 20 and more particularly, the lower connector 39, to interconnect the clamping assembly 20 to an anchor. A swivel 72 may be located along upper and/or lower ends of the elongated member 73 to prevent the elongated member 73 from twisting and causing the containment booms 12 to rotate. Various types of elongated members 73 may be utilized, such as rope, chain, cable, etc. The anchors 75 may be suspended or rest upon the floor of the body of water. The anchors 75 may be comprised of various structures, such as cement pads, hooked structures, etc.

D. Operation of Preferred Embodiment.

In use, the frame sections 31 of the clamping assembly 20 are unlatched thus allowing the frame sections 31 to pivotally open about one another. The frame sections 31 are extended around opposing sides of the containment boom 12 with the hinge assembly 38 generally located upon a bottom end. The frame sections 31 are vertically oriented and closed over the containment boom 12 and latched together via hooking the latch 42 to the receivers 46 which causes the resilient retainers 50 to compress and frictionally engage and grasp the sides of the containment boom 12. The clamp assembly 20 is now locked in place relative the containment boom 12.

The anchor assembly 70 extending from the lower end of the clamping assembly 20 retains the clamping assembly 20 and containment boom 12 in a given location. The present invention may be attached to the containment boom 12 along various locations of the containment boom 12, such as at a folding or bending portion of the containment boom 12 between adjacent floats, at connecting points of adjacent containment booms 12, or various other locations along a length of the containment boom 12.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A containment boom mooring system, comprising:

a clamping frame having a first section and a second section;

said first section and said second section pivotally connected upon a first end and having a latching means upon a second end for securing said first section and said second section in a pivotally closed position;

a first retainer and a second retainer, said first retainer extending along an inner side of said first section to frictionally engage a first side of a containment boom and said second retainer extending along an inner side of said second section to frictionally engage a second side of a containment boom;

a first buoyancy member and a second buoyancy member, said first buoyancy member extending from said first section and said second buoyancy member extending from said second section;

said first section including a first upper retaining bracket and a first lower retaining bracket for supporting said first buoyancy member in a vertical orientation;

said second section including a second upper retaining bracket and a second lower retaining bracket for supporting said second buoyancy member in a vertical orientation; and an anchor assembly extending from said clamping frame, said anchor assembly adapted to extend below a water surface for mooring said clamping frame.

2. The containment boom mooring system of claim 1, wherein said first section includes at least one first channel member extending along a longitudinal axis for receiving said first retainer and wherein said second section includes at least one second channel member extending along a longitudinal axis for receiving said second retainer.

3. The containment boom mooring system of claim 2, wherein said at least one first channel member includes at least one first outer channel member and a first inner channel member retained within said at least one first outer channel member and wherein said at least one second channel member includes at least one second outer channel member and a second inner channel member retained within said at least one second outer channel member.

4. The containment boom mooring system of claim 3, wherein said first inner channel member includes a first retaining lip for receiving a first longitudinal notch of said first retainer and wherein second inner channel member includes a second retaining lip for receiving a second longitudinal notch of said second retainer.

5. The containment boom mooring system of claim 1, wherein said latching means includes a T-shaped latch pivotally connected to said first section and at least one receiver extending from said second section for retaining said T-shaped latch.

6. The containment boom mooring system of claim 5, wherein said at least one receiver includes a pair of spaced-apart receivers, each having a curved hook portion for retaining said T-shaped latch.

7. The containment boom mooring system of claim 1, wherein said first retainer and said second retainer are each comprised of a resilient and compressible material.

8. The containment boom mooring system of claim 7, wherein said first retainer and said second retainer each include a receiver portion inserted within said first section and said second section and each include a dome-shaped contact portion extending inwardly from said first section and said second section.

9. The containment boom mooring system of claim 8, wherein said dome-shaped contact portion of said first retainer and said second retainer includes a longitudinal channel extending therethrough.

10. The containment boom mooring system of claim 1, wherein said first retainer extends along a substantial entire length of said first section and wherein said second retainer extends along a substantial entire length of said second section.

11. The containment boom mooring system of claim 1, wherein said clamping frame includes a lower connector extending from a bottom end, wherein said anchor assembly is connected to said lower connector.

12. A containment boom mooring system, comprising:

a containment boom, said containment boom floating in a water body and positioned in a substantially horizontal orientation;

a clamping assembly clamped around said containment boom, said clamping assembly secured in a vertical orientation to perpendicularly intersect a longitudinal axis of said containment boom;

said clamping assembly having a pair of resilient and compressible retainers, each retainer frictionally engaging an opposing side of said containment boom to lock said clamping assembly to said containment boom;

said clamping assembly having at least one buoyancy member extending therefrom for retaining said clamping assembly in said vertical orientation;

wherein said clamping assembly includes a frame having a first section and a second section, said first section and said second section pivotally connected upon a first end and having a latching means upon a second end for securing said first section and said second section in a pivotally closed position around said containment boom;

said first section including a first upper retaining bracket and a first lower retaining bracket for supporting said first buoyancy member in a vertical orientation;

said second section including a second upper retaining bracket and a second lower retaining bracket for supporting said second buoyancy member in a vertical orientation; and an anchor assembly extending from said clamping assembly, said anchor assembly adapted to extend below a water surface for mooring said clamping assembly and said containment boom.

13. The containment boom mooring system of claim 12, wherein said first section includes at least one first channel member extending along a longitudinal axis for receiving said first retainer and wherein said second section includes at least one second channel member extending along a longitudinal axis for receiving said second retainer, wherein said at least one first channel member includes at least one first outer channel member and a first inner channel member retained within said at least one first outer channel member and wherein said at least one second channel member includes at least one second outer channel member and a second inner channel member retained within said at least one second outer channel member, wherein said first inner channel member includes a first retaining lip for receiving a first longitudinal notch of said first retainer and wherein second inner channel member includes a second retaining lip for receiving a second longitudinal notch of said second retainer.

14. The containment boom mooring system of claim 12, wherein said latching means includes a T-shaped latch pivotally connected to said first section and at least one receiver extending from said second section for retaining said T-shaped latch, wherein said at least one receiver includes a pair of spaced-apart receivers, each having a curved hook portion for retaining said T-shaped latch.

15. The containment boom mooring system of claim 12, wherein said first retainer and said second retainer each include a receiver portion inserted within said first section and said second section and each include a dome-shaped contact portion extending inwardly from said first section and said second section.

16. The containment boom mooring system of claim 15, wherein said dome-shaped contact portion of said first retainer and said second retainer includes a longitudinal channel extending therethrough.

17. The containment boom mooring system of claim 12, wherein said first retainer extends along a substantial entire length of said first section and wherein said second retainer extends along a substantial entire length of said second section.

18. The containment boom mooring system of claim 12, wherein said clamping assembly includes a lower connector extending from a bottom end, wherein said anchor assembly is connected to said lower connector.

19. A containment boom mooring system, comprising:

a clamping frame having a first section and a second section;

said first section and said second section pivotally connected upon a first end and having a latching means upon a second end for securing said first section and said second section in a pivotally closed position;

wherein said first section includes at least one first channel member extending along a longitudinal axis for receiving said first retainer and wherein said second section includes at least one second channel member extending along a longitudinal axis for receiving said second retainer;

wherein said at least one first channel member includes at least one first outer channel member and a first inner channel member retained within said at least one first outer channel member and wherein said at least one second channel member includes at least one second outer channel member and a second inner channel member retained within said at least one second outer channel member;

wherein said first inner channel member includes a first retaining lip for receiving a first longitudinal notch of said first retainer and wherein second inner channel member includes a second retaining lip for receiving a second longitudinal notch of said second retainer;

wherein said latching means includes a T-shaped latch pivotally connected to said first section and at least one receiver extending from said second section for retaining said T-shaped latch;

wherein said at least one receiver includes a pair of spaced-apart receivers, each having a curved hook portion for retaining said T-shaped latch;

a first retainer and a second retainer, said first retainer extending along an inner side of said first section to frictionally engage a first side of a containment boom and said second retainer extending along an inner side of said second section to frictionally engage a second side of a containment boom;

wherein said first retainer and said second retainer are each comprised of a resilient and compressible material;

wherein said first retainer and said second retainer each include a receiver portion inserted within said first section and said second section and each include a dome-shaped contact portion extending inwardly from said first section and said second section;

wherein said dome-shaped contact portion of said first retainer and said second retainer includes a longitudinal channel extending therethrough;

wherein said first retainer extends along a substantial entire length of said first section and wherein said second retainer extends along a substantial entire length of said second section;

a first buoyancy member and a second buoyancy member, said first buoyancy member extending from said first section and said second buoyancy member extending from said second section;

said first section including a first upper retaining bracket and a first lower retaining bracket for supporting said first buoyancy member in a vertical orientation;

said second section including a second upper retaining bracket and a second lower retaining bracket for supporting said second buoyancy member in a vertical orientation; and an anchor assembly extending from said clamping frame, said anchor assembly adapted to extend below a water surface for mooring said clamping frame;

wherein said clamping frame includes a lower connector extending from a bottom end, wherein said anchor assembly is connected to said lower connector.

* * * * *